United States Patent [19]

Davidson

[11] 4,261,767

[45] Apr. 14, 1981

[54] ALLOY RESISTANT TO HIGH TEMPERATURE OXIDATION

[75] Inventor: James H. Davidson, Varennes Vauzelles, France

[73] Assignee: Creusot-Loire, Paris, France

[21] Appl. No.: 969,263

[22] Filed: Dec. 14, 1978

Related U.S. Application Data

[63] Continuation-in-part of Ser. No. 818,731, Jul. 25, 1977, abandoned.

[30] Foreign Application Priority Data

Jul. 28, 1976 [FR] France ..... 76 23007

[51] Int. Cl.[3] ..... C22C 30/00; C22C 19/05; C22C 38/06

[52] U.S. Cl. ..... 148/31; 75/122; 75/124; 75/134 F; 75/171; 148/31.5; 148/32; 148/37; 148/38

[58] Field of Search ..... 75/122, 124, 128 R, 75/128 E, 134 F, 171; 148/37, 38, 31, 31.5, 32

[56] References Cited

U.S. PATENT DOCUMENTS

| | | | |
|---|---|---|---|
| 3,362,843 | 1/1968 | Ziolkowski | 75/128 R |
| 3,754,898 | 8/1973 | McGurty | 75/122 |
| 3,865,581 | 2/1975 | Sekino et al. | 75/122 |

*Primary Examiner*—R. Dean
*Attorney, Agent, or Firm*—Haseltine and Lake

[57] ABSTRACT

An alloy which is resistant to high temperature oxidation includes by weight 15 to 30% of chromium, at least 10% of nickel, at least 20% of iron, 4 to 6% of aluminum and at least 0.001% of at least one metal belonging to the group formed by the rare earths and metals in the same category, such as yttrium and scandium.

4 Claims, 16 Drawing Figures

95Cr-5AL 9
20
13
21
14
15
16
M
18
11
5
19
6
10
22
7
95 Fe-5AL
L
95 Ni-5AL

θ
1400°c
1350°c
1300°c
18
20
19
21
14
22
25%cr
20%cr
%Ni
15
20
25
30
35
40
45
50
55

Δp (mg·cm⁻²)
9y900
9y500
9y300
Ni-20Cr-5Al-Y (0.03%)
Ni-20Cr-5Al-Y (0.042%)
9y 180
N 15c 230
15c 120
15c 320
15c 20

15L 240
15L 150
15L 50

15y 380
15y 160
15y 120
15y 90

Σ%
θ
1100°c
1200°c
1300°c
15c20
15c120
15c150
15c230
15
Fe-46Ni-25Cr
15l150
15l240
15l150
15l600
15y160
15y90
15y120
15y380
15y160a

Σ%
θ
1100°C
1200°C
1300°C
18y50
9y9600
13
13y60
9y900
9y90 yttrium in ppm
% Ni
• good forgeability
× bad forgeability yttrium in ppm.
% Ni
• good forgeability
× bad forgeability.

Δσ(MPa)
10
1
0,1
20
22
24
26
28
30
32
34
P
10
Fe-45Ni-25Cr
Ni-20Cr-5Al
80Ni-20Cr
9
13
Fe-22Cr-5Al

J·cm⁻²
100
10
1
0,1
10v40
9v90
13v60
18v50
Fe-22Cr-5Al
16h
+8h
+100h
+100h
+100h
+100h
+100h
1250°C
475°C
700°C
800°C
900°C
1000°C
1100°C

ALLOY RESISTANT TO HIGH TEMPERATURE OXIDATION

CROSS-REFERENCE TO RELATED APPLICATION

This is a continuation-in-part of Ser. No. 818,731 filed July 25, 1977, now abandoned.

SUMMARY OF THE INVENTION

The present invention relates to alloys derived from ternary iron-nickel-chromium alloys, which are endowed with high resistance to high temperature oxidation in order to be employed at high temperatures.

The alloys in accordance with the invention are particularly but not exclusively intended for the production of electrical resistors for equipment working especially in an oxidizing or weakly reducing atmosphere.

For electrical resistors binary nickel-chromium alloys and ternary iron-nickel-chromium alloys are known.

As examples of binary nickel-chromium alloys there may be mentioned the alloy containing 20% of chromium and 80% of nickel or the alloy containing 30% of chromium and 70% of nickel. The alloy with 20% of chromium has a solidus of the order of 1390° C. and may be employed practically up to 1200° C. with a reasonable length of life. This alloy may be formed by forging. These binary compositions have the disadvantages of being rich in nickel and hence of being relatively expensive and of having a poor performance in atmospheres rich in sulfur.

As examples of ternary iron-nickel-chromium alloys there may be mentioned the alloy containing 45% of nickel and 25% of chromium, the alloy containing 30% of nickel and 20% of chromium, and the alloy containing 12% of nickel and 12% of chromium. The limiting temperatures of use of these alloys are respectively of the order of 1150° C., 1100° C., and 600° C. and they get lower as the nickel content decreases. The solidus points are situated approximately between 1355° C. and 1390° C. These alloys may be forged.

The iron-nickel-chromium phase diagram shows that at less than about 25% of chromium and more than about 10% of nickel all the compositions are austenitic, that is to say, they have a face-centered cubic structure.

The austenitic binary nickel-chromium or ternary iron-nickel-chromium compositions have disadvantages. The limiting temperatures of use of these compositions are low, especially as far as the compositions with low nickel contents are concerned. Their reliability is insufficient.

Binary iron-chromium alloys containing 20 to 30% of chromium have been improved by the addition of 5 to 8% of aluminum. The Fe-Cr-Al alloys have high solidus temperatures and are very resistant to high temperature corrosion and to oxidation because of the formation of a protective layer of alumina. The binary iron-chromium alloys are ferritic, that is to say, they have a body-centered cubic structure. These alloys are very brittle at temperatures lower than about 200° C. Furthermore they have a poor creep strength. As an example of a Fe-Cr-Al alloy there may be mentioned, a known alloy containing 22% of chromium, 5% of aluminum and the balance iron.

Alloys for electrical resistors have also been improved by the addition of rare earths.

U.S. Pat. Nos. 2,687,954 and 2,687,956 describe alloys for electrical resistors on a nickel-iron-chromium base containing aluminum and at least one metal of the rare earths (cerium or lanthanum, for example) for increasing the length of life. The alumium content does not exceed 1% and the rare earth content goes up to 0.5% or 5000 ppm. Studies made by the Applicants in the perfection of the present invention show that the behavior of these alloys towards oxidation is insufficient for lack for aluminum.

The combined addition of aluminum and rare earth has been foreseen both for iron-chromium alloys and for nickel-chromium alloys.

Fe-Cr-Al rare earth alloys are known from French Pat. No. 770,112 and its Patents of Addition Nos. 48,129 and 48,508. These alloys may contain up to 10% of aluminum and between 0.05 and 2% rare earth. These alloys display the disadvantages of ferritic alloys without rare earths. Hence they have poor creep strength and are brittle. According to these French Patents and the literature, the addition of nickel would be unfavorable to this type of alloy.

Ni-Cr-Al-rare earth alloys are known from French Patent Applications Nos. 2,284,683 and 2,249,963. The alloys are costly and their temperature of use is limited, the solidus temperatures being relatively low. These alloys show loss of weight during the course of cyclic oxidation tests. Hence the oxide layer is not very adherent.

In accordance with the invention there is provided an alloy resistant to high temperature oxidation including by weight 15 to 30% of chromium; at least 10% of nickel, at least 20% of iron, 4 to 6% of aluminum and at least 0.001% of at least one metal belonging to the group formed by the rare earths and metals in the same category, such as scandium and yttrium.

The present invention corrects the disadvantages of already known electrical resistor alloys. Alloys in accordance with the invention can have with respect to alloys of Ni-Cr-Al-Y type the advantage of a better resistance to oxidation due to the unexpected discovery that the addition of iron avoids the losses of weight due to the spalling of the protective oxide layer. This addition of iron does not reduce the creep strength as long as the structure remains austenitic. Alloys in accordance with the invention have good forgeability, the unfavorable effect of the addition of aluminum being compensated by the addition of rare earths which must be kept within precise limits. Alloys in accordance with the invention may be austenitic alloys or austenoferritic alloys in which the two-phase fine-grain structure compensates for the unfavorable effect of the aluminum as far as forgeability is concerned. Alloys in accordance with the invention are superior to the known ferritic alloys as far as brittleness and creep behavior are concerned. The austenoferritic alloys in accordance with the invention have with respect to the austenitic alloys in accordance with the invention, a higher solidus temperature, superior forgeability but greater brittleness, inferior creep behavior and lower electrical resistivity. Alloys in accordance with the invention may be cast in order to constitute resistors for industrial furnaces capable of operating at 1300° C. and over, the austenoferritic alloys being particularly suitable. Alloys in accordance with the invention may be forged, the rare earth content then having to be kept within precise limits. The maximum temperatures of use of alloys in accordance with the invention are higher than the temperatures of use of already known austenitic alloys. Alloys in accordance with the invention achieve a compromise between a high solidus temperature and a reasonable price whilst preserving acceptable ductility and creep strength.

The present invention will be more fully understood from the following description of embodiments thereof, given by way of example only, with reference to the accompanying attached drawings.

BRIEF DESCRIPTION OF THE DRAWINGS

FIG. 4 shows the resistance to oxidation of alloys in accordance with the invention derived from the austenitic matrix Fe-45 Ni-25 Cr-5 Al, this resistance being defined by the variation in weight $\Delta p$ as a function of the number of cycles of thermal treatment, each cycle consisting of heating to 1300° C. followed by cooling in air;

DETAILED DESCRIPTION

Alloys in accordance with the invention contain 15 to 30% of chromium, at least 10% of nickel, at least 20% of iron, 4 to 6% of aluminum, 0.001% of at least one metal termed the "active element" in the following description and which belongs to the group formed by the rare earths and metals in the same category, such as yttrium and scandium.

Figure 1:
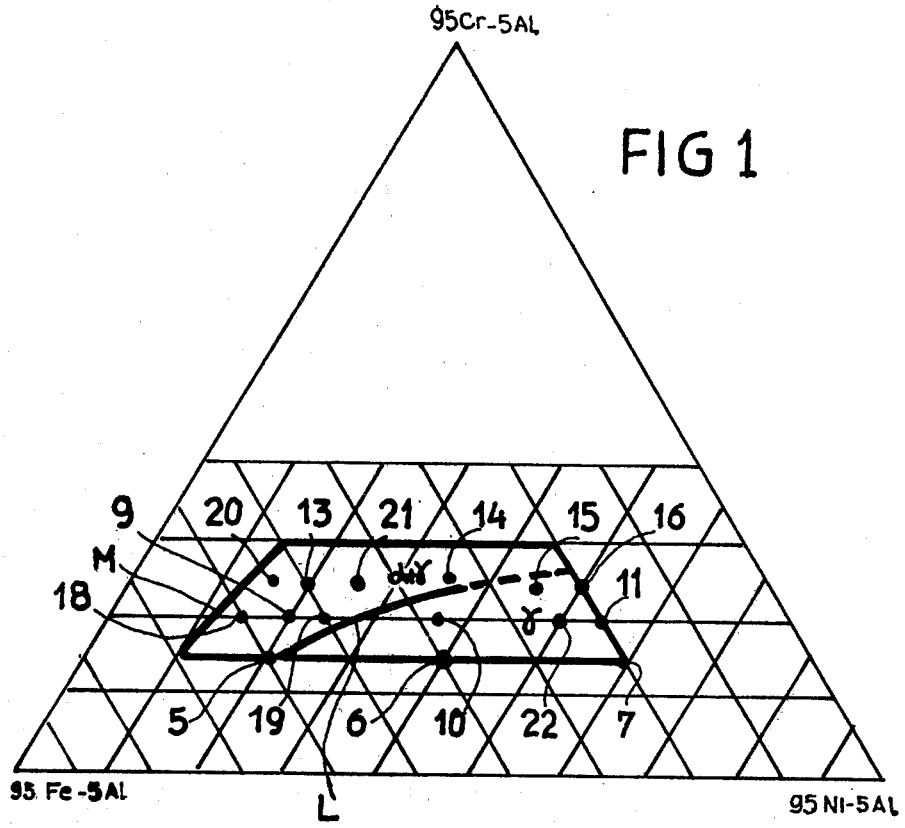
FIG. 1 shows on a diagram a certain number of iron-nickel-chromium-aluminum matrices from which alloys in accordance with the invention are derived.

FIG. 1 defines the field of alloys in accordance with the invention on a triangular chart for an average aluminum content of 5%, the content of the metal called the "active element", being less than 1%, not being taken into consideration.

The iron-nickel-chromium-aluminum matrices without rare earth or kindred metal are interesting for determination of the influences of the different constituents and for the study for the microstructure of the alloys in accordance with the invention. Table III gives the Fe-Ni-Cr-Al compositions which have been studied.

The microstructures of the iron-nickel-chromium-aluminum matrices are representative of the alloys in accordance with the invention inasmuch as the additions of "the active element" are relatively small.

Certain alloys have two-phase matrices. They include austenite alloys ($\gamma$phase) and ferrite ($\alpha$phase). Other alloys have on the contrary a single-phase austenitic matrix.

FIG. 1 defines approximately at 900° C. the field of the austenitic alloys ($\gamma$field) and the field of the austeno-ferritic alloys (field $\alpha+\gamma$).The iron, nickel and chromium contents of the austenitic alloys are approximately defined by the austenitic field of FIG. 1. This field is located with respect to the line L towards the high nickel contents. The iron, nickel and chromium contents of the austeno-ferritic alloys are approximately defined by the austeno-ferritic field of FIG. 1. This field lies between the line L and the line M. Thus the austeno-ferritic alloys in accordance with the invention include approximately more than 10% of nickel for 15% of chromium and more than 15% of nickel for 25% of chromium. However, the limit of 10% of nickel which is employed for defining the field of the alloys in accordance with the invention has the advantage of simplifying the definition of the alloys.

Table I below gives compositions by weight of austenitic alloys in accordance with the invention.

Table II below gives compositions by weight of austeno-ferritic alloys in accordance with the invention.

TABLE I

| Reference | Iron in % | Nickel in % | Chromium in % | Aluminum in % | Active Element in ppm. | Carbon in % | Silicon in % |
|---|---|---|---|---|---|---|---|
| 10 y 40 | Balance | 37.4 | 20.3 | 5.20 | 39 | 0.070 | 0.17 |
| 11 y 350 | Balance | 55 | 20 | 5 | 354 | — | — |
| 15 y 90 | Balance | 44.7 | 24.6 | 5.08 | 91 | 0.053 | 0.10 |
| 15 y 120 | Balance | 45.3 | 25.5 | 5.23 | 120 | 0.061 | 0.15 |
| 15 y 160 | Balance | 45.1 | 25.1 | 5.13 | 160 | 0.058 | 0.15 |
| 15 y 380 | Balance | 44.6 | 24.6 | 5.08 | 379 | 0.057 | 0.12 |

TABLE I-continued

| Reference | Iron in % | Nickel in % | Chromium in % | Aluminum in % | Active Element in ppm. | Carbon in % | Silicon in % |
|---|---|---|---|---|---|---|---|
| 15 l 50 | Balance | 45.0 | 25.2 | 5.15 | 49 | 0.063 | 0.15 |
| 15 l 150 | Balance | 44.9 | 24.7 | 5.03 | 150 | 0.050 | 0.13 |
| 15 l 240 | Balance | 45.1 | 25.3 | 5.17 | 239 | 0.063 | 0.16 |
| 15 c 20 | Balance | 45.0 | 25.4 | 5.18 | 23 | 0.066 | 0.15 |
| 15 c 120 | Balance | 44.9 | 24.8 | 5.08 | 116 | 0.056 | 0.13 |
| 15 c 150 | Balance | 45.0 | 25.6 | 4.92 | 158 | 0.061 | 0.16 |
| 15 c 230 | Balance | 44.9 | 24.8 | 5.08 | 233 | 0.053 | 0.14 |

TABLE II

| Reference | Iron in % | Nickel in % | Chromium in % | Aluminum in % | Active Element in ppm | Carbon in % | Silicon in % |
|---|---|---|---|---|---|---|---|
| 9 y 90 | Balance | 20.6 | 20.4 | 5.00 | 89 | 0.061 | 0.17 |
| 9 y 180 | Balance | 20.0 | 20.0 | 5.0 | 177 | 0.050 | 0.15 |
| 9 y 300 | Balance | 19.8 | 19.9 | 5.05 | 299 | 0.023 | 0.14 |
| 9 y 500 | Balance | 19.8 | 20.0 | 5.05 | 504 | 0.084 | 0.71 |
| 9 y 900 | Balance | 20.0 | 19.8 | 4.84 | 908 | 0.058 | 0.19 |
| 9 y 9600 | Balance | 19.9 | 20.0 | 5.03 | 9600 | 0.060 | 0.12 |
| 13 y 60 | Balance | 19.9 | 25.6 | 5.32 | 61 | 0.069 | 0.20 |
| 18 y 50 | Balance | 15.2 | 20.2 | 5.0 | 48 | 0.063 | 0.15 |

In Tables I and II the first reference no. of the alloy comprises a number corresponding to the nearest Fe-Ni-Cr-Al-base matrix, each number being marked on FIG. 1. The number is followed by one letter, namely c, l, y, which corresponds to the initial of the "active element" added to the basic matrix. The final number of the reference gives the content, rounded off, in ppm of "active element" contained in the alloy.

Table III below gives the compositions by weight of Fe-Ni-Cr-Al matrices lying within the limits of the alloys in accordance with the invention.

TABLE III

| Reference | Iron in % | Nickel in % | Chromium in % | Aluminum in % | Active Element in ppm |
|---|---|---|---|---|---|
| 6 | Balance | 39.9 | 15.05 | 5.02 | 0 |
| 7 | Balance | 60.00 | 15.05 | 4.84 | 0 |
| 10 | Balance | 37.44 | 20.18 | 5.08 | 0 |
| 22 | Balance | 49.80 | 20.10 | 5.25 | 0 |
| 11 | Balance | 54.80 | 20.14 | 5.03 | 0 |
| 15 | Balance | 44.55 | 24.97 | 5.09 | 0 |
| 16 | Balance | 49.76 | 24.85 | 5.14 | 0 |
| 5 | Balance | 19.84 | 15.08 | 5.08 | 0 |
| 6 | Balance | 39.9 | 15.05 | 5.02 | 0 |
| 7 | Balance | 60.00 | 20.18 | 4.84 | 0 |
| 10 | Balance | 37.44 | 20.10 | 5.08 | 0 |
| 22 | Balance | 49.80 | 20.14 | 5.25 | 0 |
| 11 | Balance | 54.80 | 24.97 | 5.03 | 0 |
| 15 | Balance | 44.55 | 24.97 | 5.09 | 0 |
| 16 | Balance | 49.76 | 24.85 | 5.14 | 0 |
| 5 | Balance | 19.84 | 15.08 | 5.08 | 0 |

Figure 2:
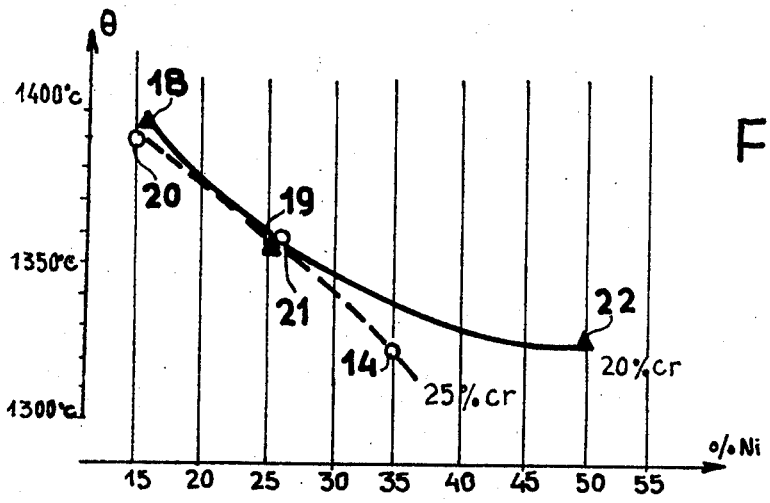
FIG. 2 shows the solidus temperatures of iron-nickel-chromium-aluminum matrices from which alloys in accordance with the invention are derived.

The alloys in accordance with the invention contain 15 to 30% of chromium. Chromium has an influence on the solidus temperature as shown in FIG. 2. Furthermore it is known that a high content of chromium favors the behavior towards corrosion by sulfur, salts, etc. . . . as well as the resistance to carburization and nitriding. Chromium enables a contiuous layer of alumnina to be formed quickly and prevents internal oxidation. It is preferable that the chromium content be higher in the alloys which are the least rich in nickel. Preferably the alloys contain from 20% to 25% of chromium.

The alloys contain at least 10% of nickel in order to ensure a sufficient fraction by volume of austenite. Austenitic alloys contain approximately between 20% and 60% of nickel. Austeno-ferritic alloys contain approximately between 10% and 50% of nickel.

Nickel has an unfavorable effect upon the solidus temperature.

Figures 4A, 4B, 4C, 5:
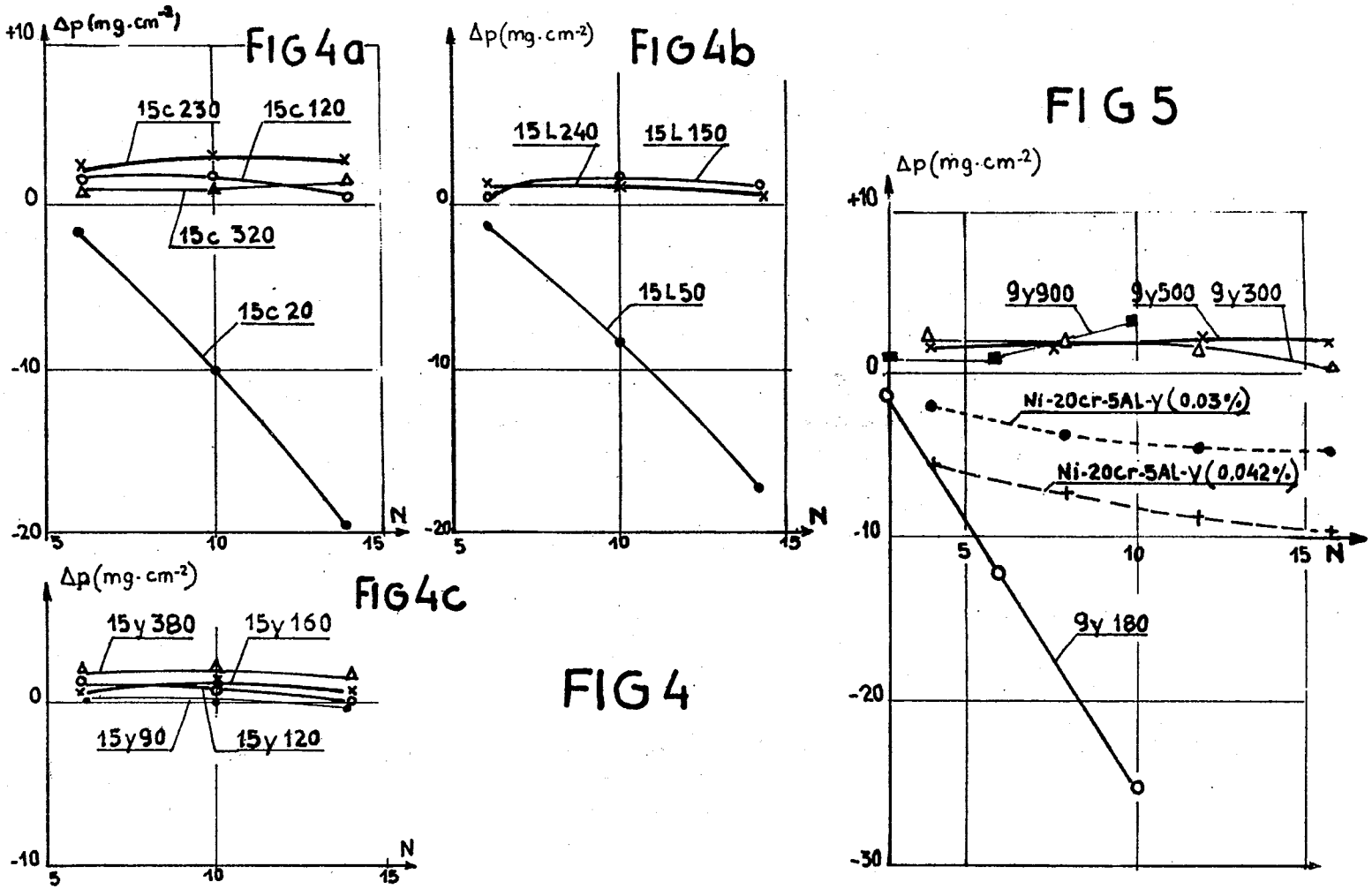
FIG. 5 illustrates the resistance to oxidation of austenoferritic alloys in accordance with the invention, this resistance being defined by the variation in weight $\Delta p$ as a function of the number N of cycles of thermal treatment, each cycle consisting of heating to 1300° C. followed by air cooling. By way of comparison the Figure shows the resistance to oxidation of known Ni-Cr-Al-Y alloys.

Nickel has an influence upon the content of "active element" which is necessary to ensure good oxidation properties. If FIGS. 4 and 5 are compared it will be found that the austeno-ferritic alloys necessitate a higher content of active element than the austenitic alloys.

Figure 10:
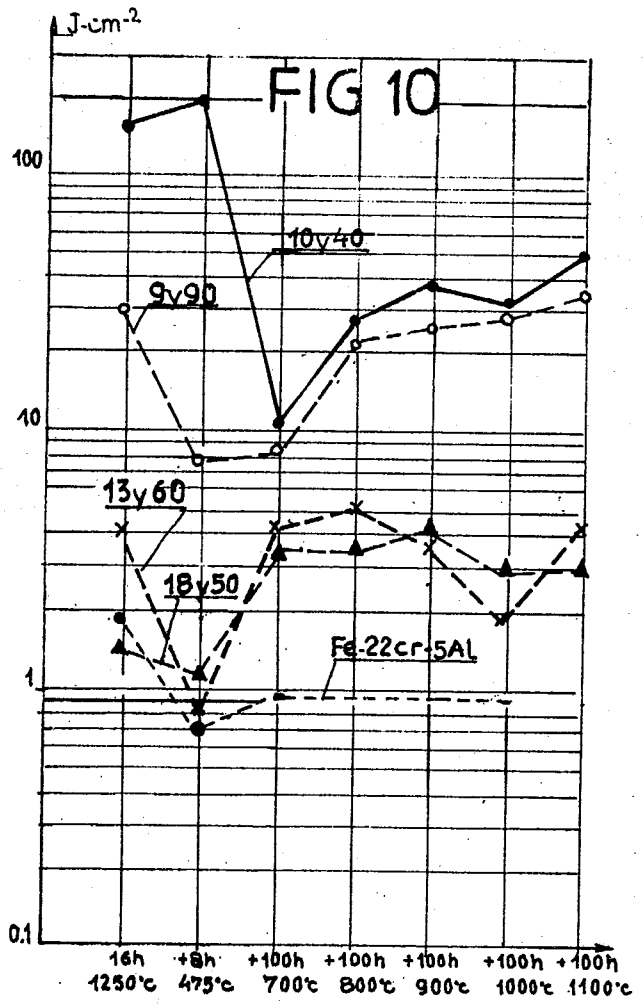
FIG. 10 shows the characteristics of the micro impact strength of austenitic and austeno-ferritic alloys according to the invention, as a function of thermal treatments.
Figure 12:
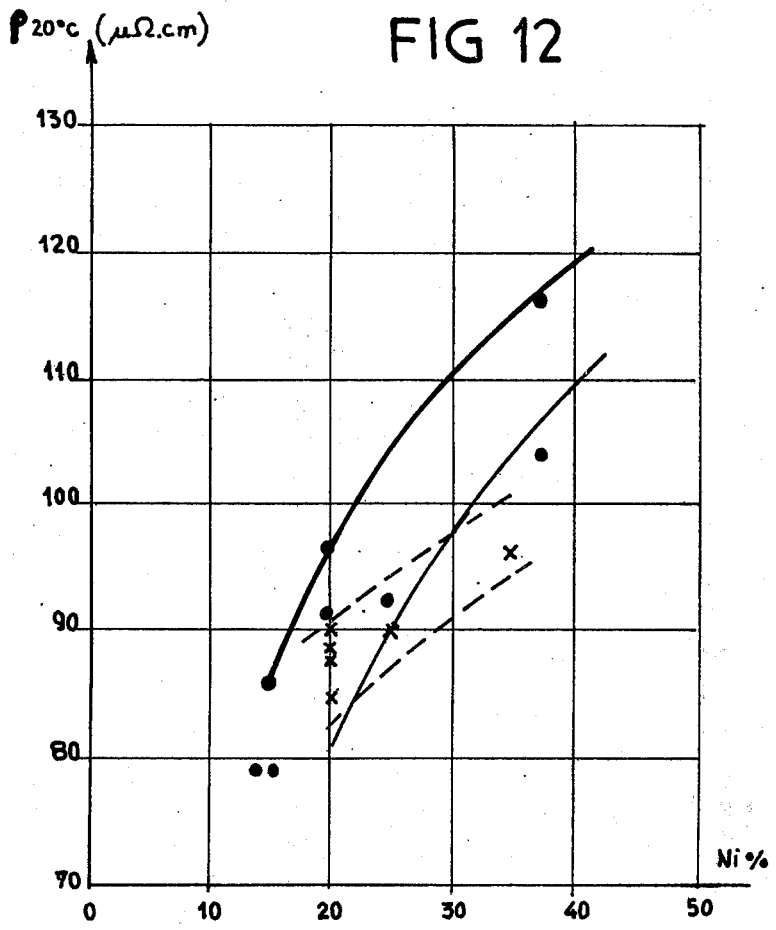
FIG. 12 shows the electrical resistivity of various alloys according to the invention.

The addition of nickel improves the impact strength as shown in FIG. 10. The austeno-ferritic compositions in accordance with the invention have a lower impact strength than the austenitic compositions in accordance with the invention. The austeno-ferritic compositions have, however, a greater impact strength than that of the known ferritic alloy Fe-25 Cr-5 Al.

Figure 11:
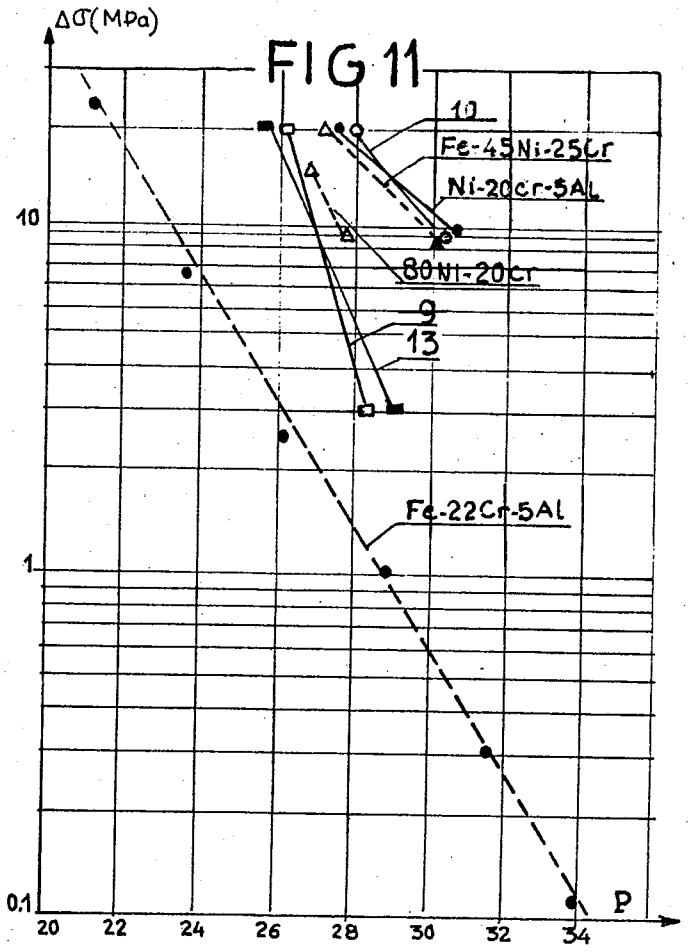
FIG. 11 shows as far as Fe-Ni-Cr-Al matrices close to the alloys according to the invention are concerned, the Larson-Miller creep curves giving the load which causes 1% elongation as a function of the parameter $P=T(20+\log t)\ 10^{-3}$ in which T is the temperature in °K. and t the time in hours.

The addition of a moderate amount of nickel is favorable to creep behavior. The Larson-Miller curves of FIG. 11 show that austeno-ferritic alloys close to alloys in accordance with the invention (alloys 9 and 13) have creep behavior inferior to the austenitic alloys close to the alloys in accordance with the invention (alloy 10). On the contrary, comparison of the characteristics of the alloys Fe-45 Ni-25 Cr and 80 Ni-20 Cr shows that the addition of iron is favorable. All the alloys in accordance with the invention are clearly stronger than the known ferritic alloy Fe-22 Cr-5 Al. At equal temperatures and for equal times the stresses which can be withstood by the austenitic and austeno-ferritic alloys are approximately and respectively 15 times and 4 times larger than those of the aforesaid ferritic alloy.

The addition of nickel has a very marked effect as far as electrical resistivity is concerned, as shown in FIG. 11, and for applications of the alloys to heating elements a high nickel content is therefore favorable. The alloys richest in this element have the highest resistivities. This result is unexpected since ferritic Fe-Cr-Al alloys with more than 15% of Cr have at ambient temperature resistivities equal to or higher than 125 $\mu\Omega$ cm whilst austenitic grades with more than 10% of Cr (without Al) have resistivities from 100 to 110 $\mu\Omega$ cm for all nickel contents greater than 25%.

The alloys in accordance with the invention contain at least 20% of iron. Austenitic alloys contain approximately between 20% and 60% of iron. Austeno-ferritic alloys contain approximately between 20% and 70% of iron.

Iron has an effect upon the solidus temperature. The solidus temperature increases with increase in the iron content as shown in FIG. 2. The solidus temperatures are at least equal to 1320° C. and are higher for the austeno-ferritics than for the austenitics.

The addition of iron tends to reduce spalling as is shown in FIGS. 4 and 5. The austeno-ferritic compositions 9 y 300, 9 y 500, 9 y 900 show no loss of weight during cyclic oxidation tests whereas austenitic compositions of Ni-Cr-Al-Y type show on the contrary losses in weight due to spalling.

The addition of iron has a favorable effect upon forgeability. The curves plotted in FIGS. 6 and 7 for rapid hot tensile tests show that the austeno-ferritic and alloys such as 13 do not exhibit the fall in ductility which the austenitic alloys such as 15 show. The fineness of the grain of the structure of the austeno-ferritic alloys has a favorable effect upon the forgeability, which compensates for the unfavorable effect of the aluminum.

The alloys in accordance with the invention contain 4 to 6% of aluminum which forms on the surface a continuous oxide layer of $Al_2O_3$ when used in an oxidizing atmosphere.

The aluminum reduces the liquidus temperature or the solidus temperature. The iron-nickel-chromium alloys containing 15 to 25% of chromium and 5% of aluminum have a solidus temperature lower than known iron-nickel-chromium alloys. In the presence of large nickel contents the reduction of the liquidus temperature goes up to 70° C.

Figure 3:
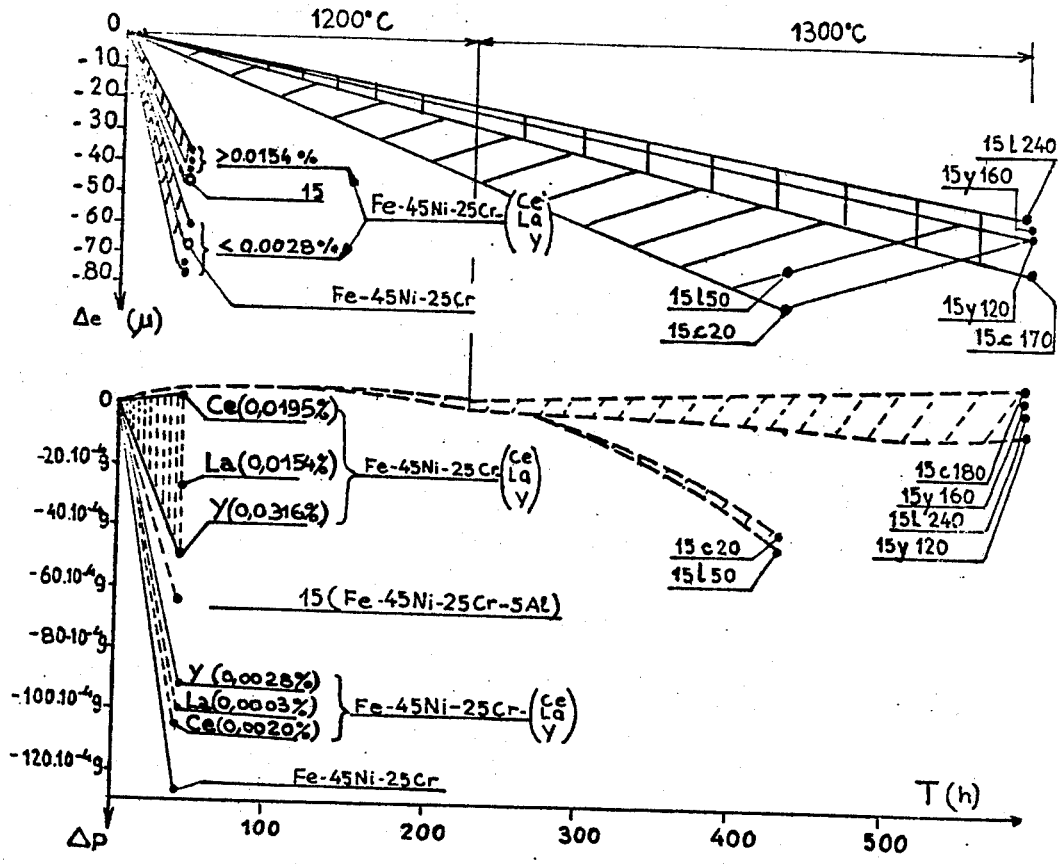
FIG. 3 shows the resistance to oxidation of different alloys in accordance with the invention derived from the austenitic matrix Fe-45 Ni-25 Cr-5 Al, this resistance being defined by the losses in thickness $\Delta e$ and by the variations in weight $\Delta p$ as a function of the time T of thermal treatment in air which consists of a succession of cycles each consisting of heating in a furnace of 1200° C. or to 1300° C. followed by cooling in air.

The addition of aluminum alone does not enable a sufficiently protective layer to be obtained to prevent internal oxidation, particularly for alloys poor in chromium and rich in iron, because the layer of alumina is not sufficiently adherent. The cyclic oxidation tests shown in FIG. 3 show that in the case of the alloy Fe-45 Ni-25 Cr the addition of 5% of aluminum slightly improves the resistance to oxidation.

Figures 6, 6A, 6B, 6C:
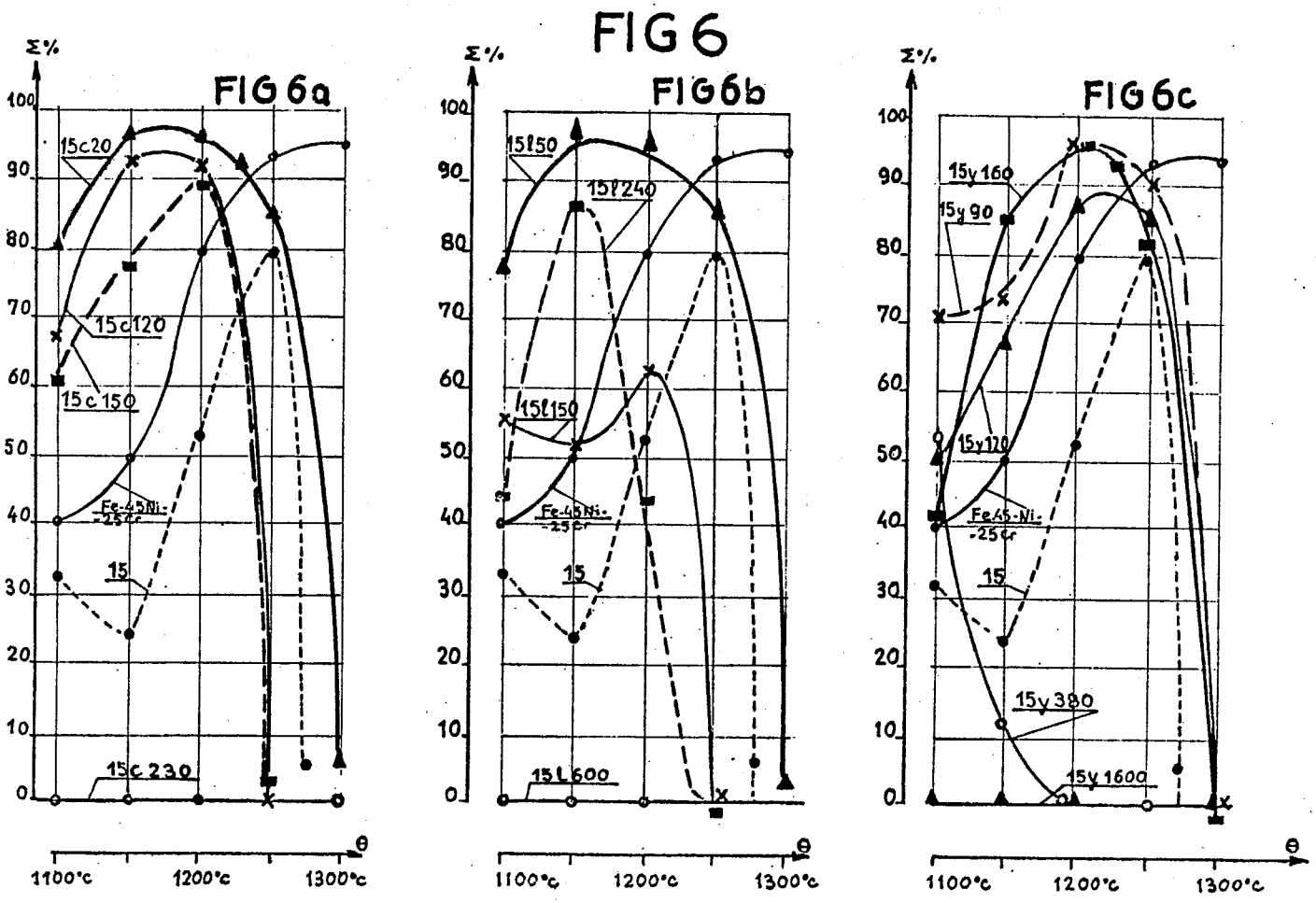
FIGS. 6*a*, 6*b* and 6*c* represent the characteristics of the reduction of area at breaking, measured by rapid hot tensile tests, of austenitic alloys in accordance with the invention.

The addition of aluminum has an unfavorable effect on forgeability. Referring to FIG. 6, comparison between the curve of reduction in area by rapid hot tensile tests on the alloy Fe-45 Ni-25 Cr and the curve of reduction in area of rapid hot tensile tests on the alloy 15 shows the negative aspect.

The alloy contains at least 0.001% (that is to say, 10 ppm), of at least one metal called the "active element" belonging to the group formed by the rare earths in particular cerium and lanthanum and by metals in the same category such as yttrium and scandium. The metals which are particularly suitable are, besides yttrium, the rare earth metals such as cerium or lanthanum. Other rare earth metals the properties of which are very close to the aforesaid element may equally well be used.

The addition of an "active element" belonging particularly to the group cerium, lanthanum, yttrium, scandium, spectacularly improves the resistance to cyclic oxidation of a Fe-Ni-Cr matrix. FIG. 3 relates to Fe-45 Ni-25 Cr matrix and shows that the resistance increases in the order:

1—addition of a low content of "active element".

2—addition of 5% by weight of aluminum.

3—addition of a high content of "active element".

4—addition of a low content of "active element" and 5% of aluminum.

5—addition of a high content of "active element" and 5% aluminum.

The active element increases the resistance to oxidation of each alloy in accordance with the invention, e.g. 15 c 120, or a value greater than the resistance to oxidation of the corresponding matrix Fe-Ni-Cr-Al, e.g. 15.

The difference in behavior between the alloys containing 5% of aluminum and respectively a low content of "active element" and a high content of this element is considerable. However, the effect of a few ppm of a metal of the rare earths or of a metal in the same category, in the presence of aluminum, is remarkable.

The austeno-ferritic alloys in accordance with the invention must have a larger content of "active element" than the austenitic alloys as is shown by FIGS. 4 and 5.

The cyclic oxidation tests at 1300° C. which are shown in FIG. 4 and which are relative to the austenitic matrix 15 show that additions of 20 ppm of cerium and 50 ppm of lanthanum are insufficient but that on the contrary additions of the order of 100 ppm are satisfactory.

Preferably the austenitic alloys in accordance with the invention contain at least 100 ppm (0.01%) of "active element" to have a particularly high resistance to oxidation.

The tests shown in FIG. 5 show that, as far as the austeno-ferritic alloys are concerned, an addition of the order of 180 ppm of "active element" (alloy 9 y 180) is not completely satisfactory.

Preferably the austeno-ferritic alloys in accordance with the invention should contain at least 200 ppm (0.02%) of "active element" to have a particularly high resistance to oxidation.

The addition of the "active element" has a considerable effect upon forgeability as measured by rapid hot tensile tests.

The addition of the "active element" improves the ductility of austenitic compositions close to the compositions in accordance with the invention but containing no aluminum. The forgeability falls when the content of active element is too high.

As far as the austenitic alloys in accordance with the invention are concerned, FIG. 6 shows that the collapse in the ductility occurs at a temperature which is lower, the higher the content of active element. Yttrium is the most favorable from this point of view.

Figures 7, 8, 9:
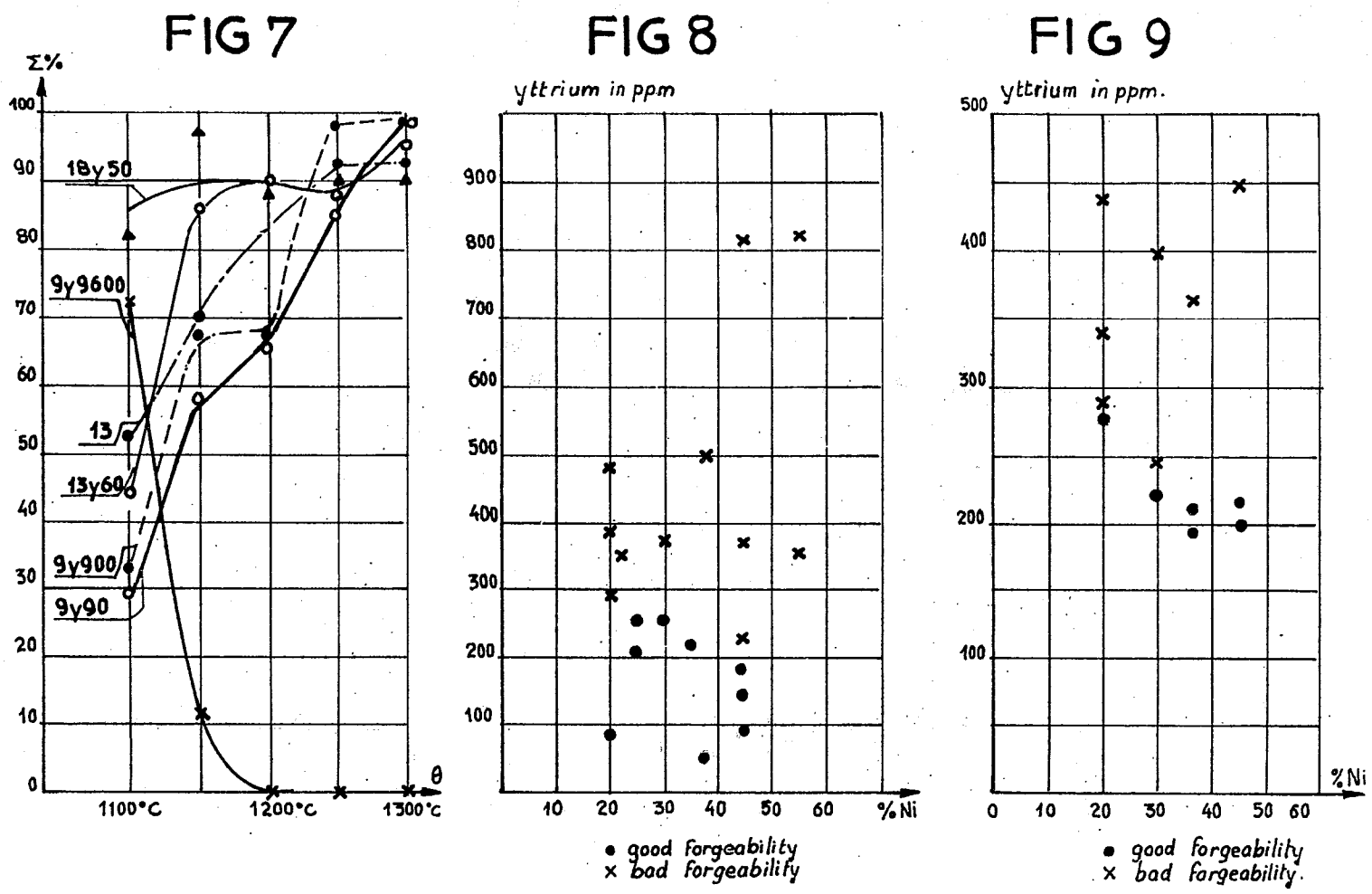
FIG. 7 represents the characteristics of the reduction of area at breaking, measured by rapid hot tensile tests, of austenoferritic alloys embodying the invention.
FIG. 8 shows as a function of nickel, the approximate upper limit yttrium for forgeable alloys in accordance with the invention, the criterion of a good forgeablilty being a reduction of area greater than 50%, measured by rapid hot tensile tests between 1100° and 1250° C.
FIG. 9 shows, as a function of nickel, the approximate upper limit of yttrium for forgeable alloys in accordance with the invention, based on the results of forging trials carried out with 50 kg ingots on the industrial drop-forge.

As far as the austenitic alloys are concerned, FIG. 6 shows that the limit compatible with a reasonable forgeability lies at about 150 ppm in the case of cerium, 150 to 200 for lanthanum, and between 160 and 380 ppm for yttrium. FIGS. 8 and 9 show that the limiting content which preserves good forgeability is lower than 400 ppm of yttrium (0.04%). The upper limit of "active element" which preserves good forgeability is lower than 400 ppm (0.04%). The upper limit of "active element" for forgeable austenitic alloys is about 0.04%.

FIGS. 8 and 9 show that the upper limit of "active element" which preserves good forgeability is lower than 400 ppm (0.04%) for austeno-ferritic alloys containing 20% or 25% of nickel.

The active element bracket for obtaining both good resistance to oxidation and good forgeability lies approximately preferably between 100 and 400 ppm (0.01% to 0.04%) as far as certain austenitic alloys are concerned.

Apart from one apparently anomalous result for the alloy 9 y 900 (FIGS. 7 and 8), FIGS. 8 and 9 show that the limiting content which preserves good forgeability in the austeno-ferritic alloys is lower than 400 ppm yttrium (0.04%).

The active element bracket for obtaining resistance to oxidation and forgeability lies between 200 ppm and 400 ppm (0.02% to 0.04%) as far as certain austeno-ferritic alloys are concerned. The upper limit is about 0.04% for forgeable austeno-ferritic alloys.

The upper limit of the "active element" corresponds approximately to the solubility limit of said "active element" which is approximately equal to 300 ppm (0.03%). Beyond this limit, the active element forms intermetallic compounds which lower forgeability as well as the solidus temperature.

The total amount of "active element" defined by the aforesaid bracket is that which is not combined with sulfur or oxygen in the form of a rare earth oxide, sulfide or oxysulfide.

In the bulk of the alloy, under the protective layer of alumina, the total amount of "active element" considered is that which is in solid solution. The amount considered does not include the active element which reacts with oxygen and sulfur during melting. On the contrary, the oxides, sulfides and oxysulfides formed during melting should preferably be eliminated as far as possible before teeming the ingot and their active element content must be allowed for when calculating the total addition.

An excessive content of the "active element" reduces the resistance to oxidation. This reduction may occur when the content is higher than 0.03%.

As far as castable austeno-ferritic alloys in accordance with the invention are concerned, the said upper limits of "active element" are not imperative. An excessive addition of "active element" may lower the incipient melting temperature as well as resistance to oxidation. Thus the upper limit of "active element" is 1% preferably 0.1% for castable austeno-ferritic alloys.

The alloys in accordance with the invention may contain carbon and silicon. Increase in the contents of silicon and of carbon lowers the liquidus and, above all, the solidus temperatures. The influence of the carbon is not very great, particularly for contents less than 0.08%.

When the solidus or liquidus temperature is important, the alloys in accordance with the invention contain less than 0.15% of silicon and less than 0.15% of carbon. For applications in which the creep strength is more important than the solidus temperature, a carbon content up to 0.4% may be tolerated.

The alloys may contain impurities such as phosphorus, sulfur, manganese etc.

The melting and processing of the alloys in accordance with the invention are carried out by conventional means.

I claim:

1. An alloy having good forgeability and resistance to high temperature oxidation, consisting essentially of, by weight, 15% to 30% of chromium, at least 10% of nickel, at least 20% of iron, 4% to 6% of aluminum capable of forming a protective layer of alumina, the iron, nickel and chromium contents being approximately defined in the austenitic field of FIG. 1, up to 0.15% of silicon, up to 0.4% of carbon, at least one metal capable of increasing resistance to oxidation at a value greater than the value of the resistance to oxidation of the corresponding matrix iron, chromium, nickel, aluminum and selected from the group consisting of rare earths and metals of the same category capable for increasing the resistance to oxidation in an amount from 0.001% to 0.03% in solid solution and not combined with sulfur or oxygen.

2. An alloy having good forgeability and resistance to high temperature oxidation, consisting essentially of, by weight, 15% to 30% of chromium, at least 10% nickel, at least 20% of iron, 4% to 6% of aluminum, capable of forming a protective layer of alumina, the iron, nickel and chromium contents being approximately defined in the austenitic field of FIG. 1, up to 0.15% of silicon, up to 0.4% of carbon, at least one metal selected from the group consisting of yttrium, cerium and lanthanum in an amount from 0.001% to 0.03% in solid solution and not combined with sulfur or oxygen.

3. An alloy having good forgeability and resistance to high temperature oxidation consisting essentially of, by weight, 15% to 30% of chromium, at least 10% of nickel, at least 20% of iron, 4% to 6% of aluminum capable of forming a protective layer of alumina, the iron, nickel and chromium contents being approximately defined in the austeno-ferritic field of FIG. 1, up to 0.15% of silicon, up to 0.4% of carbon, at least one metal selected from the group consisting of cerium, lanthanum, and yttrium in an amount from 0.001% to 0.03% in solid solution and not combined with sulfur or oxygen.

4. An alloy having good forgeability and resistance to high temperature oxidation consisting essentially of, by weight, 15% to 30% of chromium, at least 10% of nickel, at least 20% of iron, 4% to 6% of aluminum capable of forming a protective layer of alumina, the iron, nickel and chromium contents being approximately defined in the austeno-ferritic field of FIG. 1, up to 0.15% of silicon, up to 0.4% of carbon, at least one metal selected from the group consisting of the rare earths and metals in the same category in an amount from 0.001% to 0.03% in solid solution and not combined with sulfur or oxygen.

* * * * *